United States Patent [19]

Molins

[11] 4,197,864

[45] Apr. 15, 1980

[54] CONVEYING ROD-LIKE ARTICLES

[75] Inventor: Desmond W. Molins, London, England

[73] Assignee: Molins Ltd., United Kingdom

[21] Appl. No.: 858,012

[22] Filed: Dec. 6, 1977

[30] Foreign Application Priority Data

Dec. 15, 1976 [GB] United Kingdom ..... 52250/76

[51] Int. Cl.[2] ..... A24C 5/58

[52] U.S. Cl. ..... 131/94; 93/77 FT

[58] Field of Search ..... 131/25, 27 R, 27 A, 131/28, 29, 32, 33, 36, 58, 61 R, 61 A, 76, 88, 94; 93/77 FT

[56] References Cited

U.S. PATENT DOCUMENTS

| | | | |
|---|---|---|---|
| 2,649,761 | 8/1953 | Edwards | 131/76 |
| 3,164,242 | 1/1965 | Schubert et al. | 131/94 |
| 3,513,856 | 5/1970 | Sexstone et al. | 131/94 |
| 4,040,430 | 8/1977 | Molins | 131/94 |
| 4,077,415 | 3/1978 | Preston et al. | 131/76 |

FOREIGN PATENT DOCUMENTS

| | | |
|---|---|---|
| 876732 | 9/1961 | United Kingdom . |
| 886657 | 1/1962 | United Kingdom . |
| 1396318 | 6/1975 | United Kingdom . |

*Primary Examiner*—Robert W. Michell
*Assistant Examiner*—C. F. Rosenbaum
*Attorney, Agent, or Firm*—Craig and Antonelli

[57] ABSTRACT

In a method of uniting axially aligned rod-like articles by wrapping a wrapper section around the junction between the articles, an air flow is used to move the articles into abutment and to axially align them relative to the wrapper section. Principally for use in making filter cigarettes, suction may be applied to the ends of the flutes of an aligning drum which feeds filter portions and tobacco sections onto the rolling plate. The suction preferably moves the filter portion against a stop in its flute, and acts through the filter portion to close up the tobacco section.

15 Claims, 5 Drawing Figures

CONVEYING ROD-LIKE ARTICLES

Figure 1:
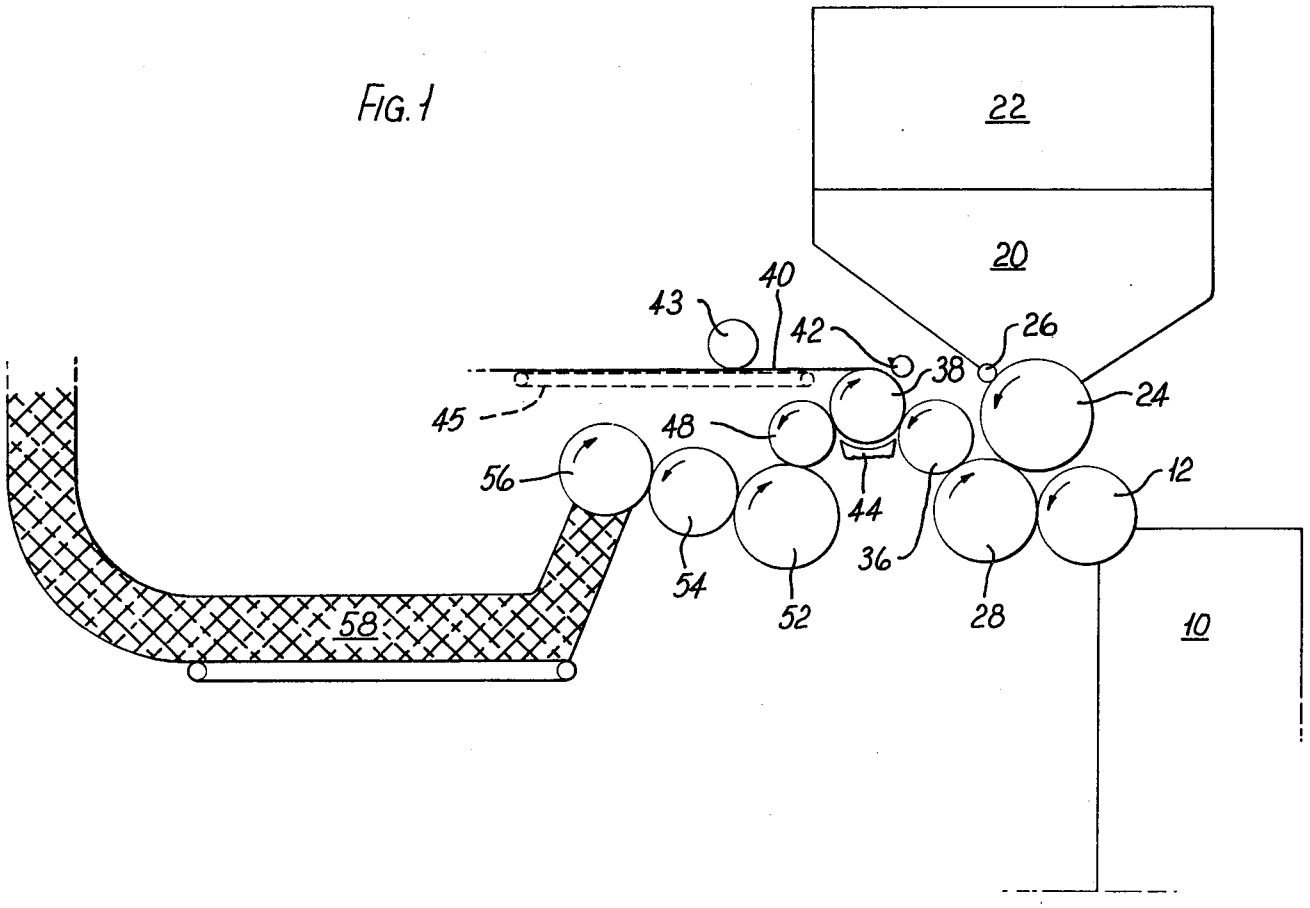
Figure 2:
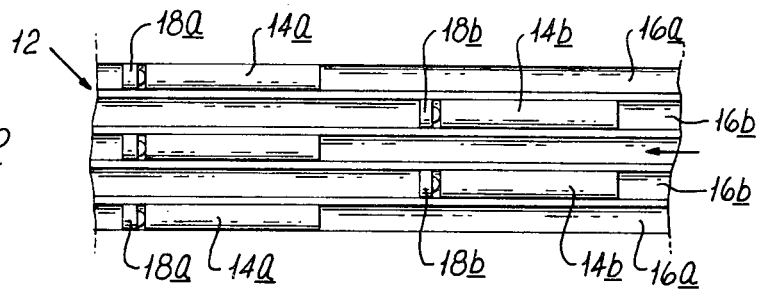
Figure 3:
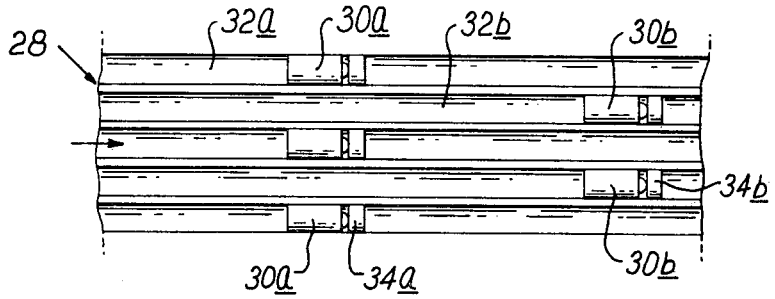

This invention is concerned with uniting rod-like articles, particularly but not exclusively in the manufacture of filter-tipped cigarrettes having a filter portion united to a tobacco section. For convenience, the term "filter" is generally used herein, but the invention is applicable to any mouthpiece which may be attached to the tobacco section to produce a tipped cigarette, and is not limited to mouthpieces which actually provide a filtering action.

In a conventional way of making filter cigarettes a double length filter portion is placed in line between two tobacco sections and joined to them by rolling in a wrapper section which spans the length of the filter portion and overlaps the tobacco section. Exact axial registration of the wrapper section with the filter portion and tobacco section is not particularly critical, as long as there is sufficient overlap. Individual filter cigarettes are obtained by cutting the resulting assemblage at its mid-point. Apparatus for producing filter cigarettes in this manner is described for example in British Pat. No. 886,657.

Another possible way of making filter cigarettes comprises aligning single length tobacco sections with single length filter portions and joining each such assembly by rolling it in a wrapper section to produce an individual filter cigarette. For example, U.S. Pat. No. 4,040,430 discloses such a method, in which the tobacco sections and filter portions are preferably united by means of a rolling ring tipping method in which the wrapper section uniting the assembly comprises a uniting band which overlaps the adjacent end portions only of the filter portion and tobacco section. As before, exact registration of the uniting band is not required, as long as there is sufficient overlap.

When it is desired to produce a conventional filter cigarette (i.e. a cigarette having a filter portion attached to a tobacco section by a wrapper section which spans the whole length of the filter portion and overlaps the tobacco section) by a method in which individual single-length components are assembled and joined together, accurate axial registration of the wrapper section relative to the filter portion becomes important, since the free end of the filter portion should coincide with the edge of the wrapper section. The wrapper sections are normally severed from a web on a suction conveyor (the rolling drum) and lateral positioning of the web can be achieved by means such as a suction guide tape supporting the web feed to the conveyor or by lateral guides for the edges of the web and through which the web is constrained to pass.

The filter portion and tobacco section are normally fed towards the same suction conveyor in the flutes of a drum. Axial positioning and closing up of the components of each assembly comprising a filter portion and tobacco section has in the past been performed by pushing the components against stops in the flutes using an inclined guide surface. Thus, in said U.S. Pat. No. 4,040,430, one proposal is that a resilient metal strip is arranged around part of the periphery of a fluted drum and at an inclined position so that components are pushed onto stops in their flutes as they are conveyed past the strip by the drum. One disadvantage of using inclined guides to position the components of an assembly against a stop in a flute is that since it is the filter portion which is required to be accurately positioned this is the component which should be against the stop. Consequently, movement to close up the assemblies and move them against their stops by means of guide surfaces involves pushing on the ends of the tobacco sections, which could become damaged as a result.

According to the present invention a method of uniting rod-like articles comprises moving axially aligned first and second rod-like articles in a direction transverse to their lengths, subjecting said articles to an air flow which tends to move one end of the first article to a predetermined axial position and tends to move the second article into abutment with the other end of the first article, feeding a wrapper section to a position overlapping the junction between said articles, and wrapping the wrapper section around the junction to unite the first and second articles. Normally the method would include the steps of pneumatically moving the first article to a predetermined axial position, with one end against a stop for example, and pneumatically moving the second article against the other end of the first article: these steps could occur simultaneously. The air flow is preferably substantially axial and could be produced by reduced pressure at or near said one end of the first article so that at least part of the air flow influencing the second article can pass through the first article if the latter is air permeable.

The method may be used for making filter cigarettes, the filter portion being the first rod-like article and the tobacco section the second rod-like article. Accurate positioning of the filter portion is then obtained without the disadvantage of the prior art arrangements. The wrapper section is preferably guided so that one edge is aligned with said predetermined axial position.

In a preferred form of apparatus the rod-like articles are conveyed in a flute of a drum and the predetermined axial position is defined by a stop in the flute. The first article may be moved against the stop by suction applied through an air-permeable part of the stop (or simply from behind the stop so that an air flow is created around the stop). Suction can be supplied from a first suction manifold rotatable with the drum, which manifold communicates with a stationary second suction manifold.

In a further, general aspect of the invention, first and second axially aligned rod-like articles are arranged in a carrier for movement transverse to their lengths, and the first article is moved to a predetermined axial position in said carrier by means of suction applied at or near one end of said article, and the second article is closed up to the other end of the first article at least partly by means of suction applied through the first article.

The invention will now be further described, by way of example only, with reference to the accompanying drawings in which:

FIG. 1 is a diagrammatic side elevation of apparatus for assembling filter cigarettes, and FIGS. 2 to 5 are respective plan views of parts of fluted drums in the apparatus of FIG. 1.

FIG. 1 shows a cigarette making machine bed 10 from which a line of endwise-moving tobacco sections are delivered into a rotating catcher drum 12. As can be seen from FIG. 2, alternate tobacco sections **14*a* and 14*b* are received in flutes 16*a* and 16*b* respectively which have stops 18*a* and 18*b* respectively positioned at different distances along the drum 12** so that a staggered formation of tobacco sections is obtained.

Referring once again to FIG. 1, a hopper 20 is arranged to receive filter rod lengths from a tray 22. The filter rods, which may be six times the length of an individual filter portion, are delivered into flutes of a drum 24 at the base of the hopper, on which drum they are cut into individual filter portions by rotary knives such as that shown at 26. A line of endwise-moving filter portions for delivery to a further drum 28 is formed by stripping successive flutes of the drum 24. One way of achieving this is described in British Pat. No. 876,732. Alternate filter portions 30*a* and 30*b* (FIG. 3) are received on drum 28 in flutes 32*a* and 32*b* respectively having stops 34*a* and 34*b* positioned so that a staggered formation of filter portions is obtained.

Figure 4:
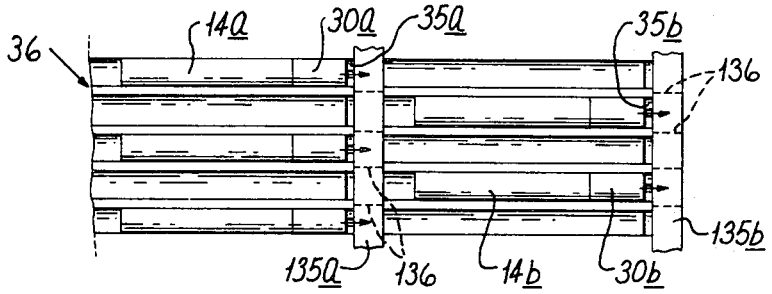
Figure 5:
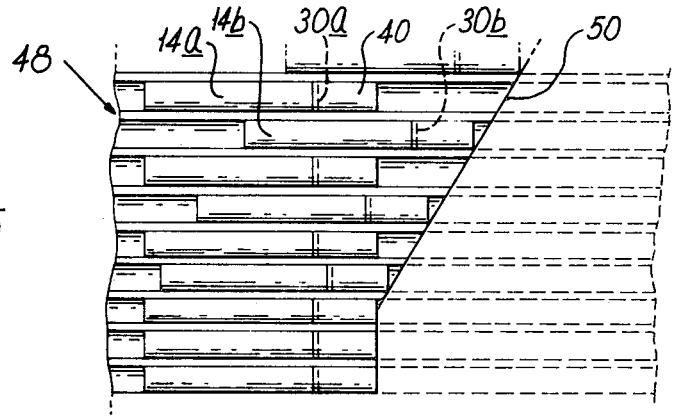

The staggered formation of tobacco sections is delivered to the drum 28 from the drum 12 so that the tobacco sections 14*a* occupy the flutes 32*a* alongside the filter portions 30*a* and the tobacco sections 14*b* occupy the flutes 32*b* alongside the filter portions 30*b*. Subsequently the assemblies are transferred to an ends closure drum 36 where the individual components in each flute are accurately aligned and brought into abutment (as will be described in more detail later). The position of the components in the drum 36 is shown in FIG. 4.

The assemblies 14*a*, 30*a* and 14*b*, 30*b* are each transferred from the drum 36 to a suction rolling drum 38 where each assembly is formed into a filter cigarette by wrapping a wrapper section around the filter portion 30 and adjacent end of the tobacco section 14. The wrapper sections are formed from two substantially parallel spaced strips 40 of wrapper material fed to the drum 38 and cut into lengths of wrapper section by a pair of rotary knife carriers 42. One or more pasters 43 is provided to apply adhesive to the upper surface of the strips 40. The suction rolling drum 38 cooperates with a rolling plate 44 (which may comprise a pair of rolling plates in parallel, one for each of the assemblies a and b) to wrap a wrapper section around each assembly to form a filter cigarette. Details of a rolling operation using a rolling drum and a rolling plate, whereby rod-like articles in axial abutment are joined, are disclosed in British Pat. No. 886,657.

One or more removable suction band conveyors 45 are provided for setting up the strips 40 between feed rollers (not shown) and the rolling drum 38 and for accurately positioning the strips relative to the axis of drum 38. The feed of the strips 40 may be similar to that of the strips 282 in U.S. patent application Ser. No. 808,366, now U.S. Pat. No. 4,103,596. The conveyor 45 could be moved away as by a hinged mounting after the strips have been tensioned by the rolling drum but it is preferred to retain some form of guide means for accurate lateral positioning of the strips.

After rolling, the filter cigarettes are passed to a further fluted drum 48 (FIG. 1) which carries them past an inclined guide surface 50 (FIG. 5) so that the two rows of cigarettes are brought into alignment. Subsequently the cigarettes are transferred, via another drum 52 to the drums 54, 56 of a cigarette inspection device. Satisfactory cigarettes are conveyed away as a stack 58 for delivery to a cigarrette packing machine.

In order to produce acceptable filter cigarettes, with the free ends of the wrapper section and filter portion coinciding, it is necessary to accurately position the strips 40 and cigarette assemblies as they are fed to the rolling drum 38. As previously mentioned, the suction tape or tapes 45 (or other guide means such as flanged pulleys) can ensure that the strips 40 are fed in the correct position. Accurate positioning of the tobacco sections and filter portions occurs on the ends closure drum 36.

Referring to FIG. 4, the drum 36 receives the assemblies 14*a*, 30*a* and 14*b*, 30*b* from the drum 28 with slight gaps between the components of each assembly. The flutes of the drum which receive assemblies are provided with stops 35*a*, 35*b* respectively which are positioned so that each filter portion is received from the drum 28 with one end close to a stop. The stops 35*a*, 35*b* are air-permeable and communicate with respective suction manifolds 135*a*, 135*b* so that suction applied through the stops causes an air flow which draws the adjacent filter portion against the stop. Moreover the suction is sufficiently strong to act through the filter portion or around the portion and along the flute so that the corresponding tobacco portion of each assembly is drawn against the other end of the filter portion. The tobacco section may be moved simultaneously with or slightly later than the filter portion. Since the stops 35*a*, 35*b* are axially fixed relative to the rolling drum 38 subsequent feeding of the assemblies onto the drum 38 and plate 44 is accurately controlled.

The suction chambers 135*a*, 135*b* may be rotatable with the drum 36 and selectively supplied with suction, over the arc of rotation of the drum between drums 28 and 38, from a fixed suction manifold in a manner analogous to that described in British Pat. No. 1,396,318. For this purpose the chambers 135*a*, 135*b* are preferably divided by separating vanes (indicated at 136 in FIG. 4) into regions corresponding to the width of a flute.

Alternatively, the chambers 135*a*, 135*b* could themselves be fixed and the drum 36 provided with at least one peripheral groove (for chamber 135*a*). The chambers 135*a*, 135*b* would extend around the arc between drums 28 and 38 and the wiping contact between the stops 35*a*, 35*b* and the chambers 135*a*, 135*b* would seal the chambers. In another modified arrangement the stops 35*a*, 35*b* could be removed and the axial positions of the filter portions 30 be determined by the sides of the suction chambers 135*a*, 135*b* (which could be fixed or rotatable with drum 36).

The drum 36 could be provided with a peripheral shroud in the region of the arc over which suction acts on the ends of the flutes, to increase the effectiveness of the applied suction and maintain a substantial axial air flow along the flutes.

While the apparatus described involves operation in parallel of two rows of assemblies it will be appreciated that the invention is equally applicable when a single row of component assemblies is being processed to form filter cigarettes.

What is claimed is:

1. A method of uniting rod-like articles, comprising the steps of moving axially aligned first and second rod-like articles in a direction transverse to their lengths, subjecting said articles to an air flow which tends to move one end of the first article in an axial direction to a predetermined axial position and tends to move the second article in an axial direction into abutment with the other end of the first article, feeding a wrapper section to position overlapping the junction between said articles, and wrapping the wrapper section around the junction to unite the first and second articles.

2. A method as claimed in claim 1, wherein the wrapper section is guided so that one edge is aligned with said axial position.

3. A method of uniting rod-like articles, comprising the steps of moving axially aligned first and second rod-like articles in a direction transverse to their lengths, subjecting said articles to an air flow which tends to move one end of the first article to a predetermined axial position and tends to move the second article into abutment with the other end of the first article, the air flow being substantially axial relative to the rod-like articles, feeding a wrapper section to a position overlapping the junction between said articles, and wrapping the wrapper section around the junction to unite the first and second articles.

4. A method as claimed in claim 1, wherein the air flow is produced by reduced pressure adjacent said one end of the first article, so that where said first article is air permeable at least part of the air flow influencing the second article passes through the first article.

5. Apparatus for uniting rod-like articles, comprising conveyor means including at least one carrier for moving axially aligned first and second rod-like articles in a direction transverse to their lengths, means for defining a predetermined axial position relative to said articles, means for causing an air flow along said carrier to move one end of the first article to said axial position and the second article into abutment with the other end of the first article, means for feeding a wrapper section to a position overlapping the junction between the first and second articles, and means for wrapping the wrapper section around the junction to unite the first and second articles.

6. Apparatus as claimed in claim 5, including guide means for aligning one edge of the wrapper section with said predetermined axial position.

7. Apparatus for uniting rod-like articles, comprising conveyor means including at least one carrier for moving axially aligned first and second rod-like articles in a direction transverse to their lengths, means for defining a predetermined axial position relative to said articles including stop means for said first rod-like article, means for causing an air flow to move one end of the first article to said axial position and the second article into abutment with the other end of the first article, means for feeding a wrapper section to a position overlapping the junction between the first and second articles, and means for wrapping the wrapper section around the junction to unite the first and second articles.

8. Apparatus as claimed in claim 7, wherein the stop means is adapted to allow air flow past or through it.

9. Apparatus for uniting rod-like articles, comprising conveyor means including at least one carrier for moving axially aligned first and second rod-like articles in a direction transverse to their lengths, means for determining a predetermined axial position relative to said articles, means for causing an air flow to move one end of the first article to said axial position and the second article into abutment with the other end of the first article, means for feeding a wrapper section to a position overlapping the junction between the first and second articles, means for wrapping the wrapper section around the junction to unite the first and second articles, and a suction manifold communicating with said carrier to induce an air flow along said carrier.

10. Apparatus as claimed in claim 9, wherein the conveyor means is a rotatable drum having a plurality of carriers in the form of flutes.

11. Apparatus as claimed in claim 10, including a peripheral shroud around part of the arc of rotation of said drum, to increase the effectiveness of the air flow along said flutes.

12. A conveying apparatus for rod-like articles, comprising conveyor means including a plurality of carriers for moving the rod-like articles in a direction transverse to their lengths, means for defining a predetermined axial position for an article in each of the carriers, and means for causing an air flow along each carrier to move an article axially in said carrier to said predetermined axial position while said carrier moves articles in the transverse direction.

13. An apparatus as claimed in claim 12, wherein means for defining said predetermined axial position comprises stop means for the articles.

14. An apparatus as claimed in claim 13, wherein the stop means is arranged so as to allow the air flow past or through it.

15. An apparatus as claimed in claim 12, including a suction manifold communicating with said carriers to induce said air flow along the carriers.

* * * * *